US008803041B2

(12) United States Patent
Schlipf

(10) Patent No.: US 8,803,041 B2
(45) Date of Patent: Aug. 12, 2014

(54) HIGH-PERFORMANCE FLOW HEATER AND PROCESS FOR MANUFACTURING SAME

(75) Inventor: Andreas Schlipf, Tuttlingen (DE)

(73) Assignee: Türk & Hillinger GmbH, Tuttlingen (DE)

( * ) Notice: Subject to any disclaimer, the term of this patent is extended or adjusted under 35 U.S.C. 154(b) by 512 days.

(21) Appl. No.: 13/105,564

(22) Filed: May 11, 2011

(65) Prior Publication Data

US 2011/0280555 A1 Nov. 17, 2011

(30) Foreign Application Priority Data

May 12, 2010 (DE) ..... 20 2010 006 739 U
Mar. 1, 2011 (DE) ..... 10 2011 012 769

(51) Int. Cl.
*H05B 1/02* (2006.01)

(52) U.S. Cl.
USPC ..... 219/486; 219/535; 219/538; 219/548; 219/492; 392/465; 392/478

(58) Field of Classification Search
CPC ..... H05B 1/02
USPC ..... 219/482–487, 494, 534, 535, 538, 548; 392/479, 466, 478, 480, 486, 489
See application file for complete search history.

(56) References Cited

U.S. PATENT DOCUMENTS 1,595,819 A * 8/1926 Bluemlein ..... 392/481
1,608,537 A * 11/1926 Swanberg ..... 123/142.5 E
1,615,166 A * 1/1927 Cowles ..... 392/481
2,098,732 A * 11/1937 Prather ..... 433/32
2,813,964 A * 11/1957 Cerulli ..... 392/489
5,257,341 A * 10/1993 Austin et al. ..... 392/487
5,434,388 A * 7/1995 Kralik et al. ..... 219/538
5,724,478 A * 3/1998 Thweatt ..... 392/484
7,248,792 B2 * 7/2007 Mihara ..... 392/492
8,541,716 B2 * 9/2013 Gu et al. ..... 219/482

FOREIGN PATENT DOCUMENTS

DE 1845872 U 2/1962
DE 2218796 A1 10/1973
DE 2440426 A1 3/1976
DE 2454920 A1 5/1976
DE 2454920 B2 11/1978

(Continued)

*Primary Examiner* — Mark Paschall
(74) *Attorney, Agent, or Firm* — McGlew and Tuttle, P.C.

(57) ABSTRACT

A flow heater (100, 200, 300, 400, 500) with a tube arrangement including at least one tube (105, 106, 205, 206, 305, 306, 404, 405, 406) for passing through a fluid to be heated or a plurality of fluids to be heated, and with a heater with a metal jacket, especially with a tubular heating body (102, 202, 302, 402, 502), in which the tubes (105, 106, 205, 206, 304, 305, 306, 404, 405, 406, 505) surround the heater. At least in partial areas of the heater, wall sections (113, 114, 213, 214, 311, 312, 313, 411, 412, 413, 513) of the tube arrangement (105, 106, 205, 206, 304, 305, 306, 404, 405, 406), which wall sections face the heater, are adapted to an outer contour of the heater, which heater may or may not include a heat transport tube (117, 317, 517), so that the wall sections are in flush contact with sections of this outer contour. The tube arrangement (105, 106, 205, 206, 304, 305, 306, 404, 405, 406, 505) is connected together and/or with the heater by a connection device. A process for manufacturing such a flow heater is also provided.

20 Claims, 5 Drawing Sheets

(56) References Cited

FOREIGN PATENT DOCUMENTS

| | | | |
|---|---|---|---|
| DE | 3200474 | C2 | 7/1983 |
| DE | 4226325 | C1 | 9/1993 |
| DE | 29805226 | U1 | 8/1998 |
| DE | 202004009349 | U1 | 8/2004 |
| DE | 10317353 | A1 | 11/2004 |
| DE | 102005036816 | A1 | 2/2007 |

* cited by examiner

HIGH-PERFORMANCE FLOW HEATER AND PROCESS FOR MANUFACTURING SAME

CROSS REFERENCE TO RELATED APPLICATIONS

This application claims the benefit of priority under 35 U.S.C. §119 of German Utility Model DE 20 2010 006 739.1 filed May 12, 2010 and German Patent Application DE 10 2011 012 769.0 filed Mar. 1, 2011, the entire contents of each of which are incorporated herein by reference.

FIELD OF THE INVENTION

The present invention pertains to a flow heater with at least one tube for passing through a fluid to be heated or a plurality of fluids to be heated, and with a heater with a metal jacket.

BACKGROUND OF THE INVENTION

Such flow heaters are used to heat fluids (i.e., especially liquids and/or gases) and are used, for example, in dishwashers, steam cookers or washing machines and are known, for example, from DE 42 26 325 C1.

Prior-art flow heaters usually have a metal section, in which a tube for passing through a fluid to be heated is mounted. One or more adjacent tubular heating bodies, which are likewise mounted in the metal section, are arranged around the tube outside the tube interior space thereof. To guarantee a direct and close contact between the metal section and tubular heating body, on the one hand, and the metal section and tube for passing through a fluid to be heated, on the other hand, the arrangement is mostly fully or partly compressed.

The requirement on the performance of such flow heaters has noticeably increased over the last few years. It was found that the flow heaters of conventional design, as they are known from the state of the art, reach their limits with the use of tubular heating bodies of ever-increasing performance, because sufficient heat transfer into the fluid is no longer guaranteed. This leads to an unacceptably high temperature on the outside of the flow heater and in the extreme case to melting of the metal section.

In a second class of flow heaters, which are known, e.g., from DE 1 036 816 A1, a tubular heating body is arranged in the interior of a tube for passing through a fluid to be heated. Thus, it is in direct contact with the fluid, which significantly increases the risk of failure of the tubular heating body as a consequence of the interaction thereof with the fluid, because local deposits, for example, calcifications, which hinder the dissipation of heat and lead to destruction of the tubular heating body, occur in the systems used in practice in a number of applications. If corrosive media are heated, the direct contact with the fluid may likewise damage the tubular heating body. In addition, especially if they are used with high surface loads and low flow velocities, such flow heaters may cause bubbling in liquids to be heated, which will likewise lead to a local hindrance of the dissipation of heat and entails the risk of destruction.

SUMMARY OF THE INVENTION

The object of the present invention is consequently to provide a high-performance but nevertheless compact flow heater, which can be used in situations with limited availability of space and whose outer temperature remains limited and which ensures good heat transfer to the fluid, while the tubular heating body is at the same time protected from the fluid, and to develop a simple and cost-effective process for manufacturing such a flow heater.

According to the invention, a flow heater is provided comprising a heater with an outer contour and comprising a tubular heating body with a metal jacket. A tube arrangement for passing through fluid to be heated surrounds the heater at least in some sections. The tube arrangement comprises wall sections facing the heater and having a wall contour adapted at least in partial areas to the heater outer contour. The wall sections that face the heater are in flush contact with sections of this outer contour.

The tube arrangement may comprise two tubes. The tube arrangement may also comprise a single tube. The single tube may have a cross section varying in contour including a crescent-shaped cross section in a middle area and a round cross section in an end section.

A connection means may be provided for connecting the tubes to one another and/or to the heater. The connection means may comprise a tensioning means with which the tubes are braced against each other. The connection means may also be arranged between the tubes and the heater and comprise at least one of a soldered joint, a bonded joint or a weld seam.

The heater may comprise a heat transport tube provided outwardly of the tubular heating body with the metal jacket. In this case the heat transport tube defines the outer contour of the heater. The heat transport tube may be formed of a material that has a higher coefficient of thermal conduction than a material of the metal jacket. The heat transport tube may be formed of a material with a higher elasticity and/or lower hardness and/or better deformability than a material of the metal jacket.

The flow heater according to the present invention has at least one tube for passing through a fluid to be heated or a plurality of fluids to be heated, and a heater with a metal section, especially with a tubular heating body.

It is essential for the present invention that the tube arrangement surround the heater, and the sections of the walls of the tube arrangement, which said sections face the heater, are adapted, at least in partial areas of the heater, to an outer contour of the heater or to an outer contour of a heat transport tube arranged on the heater, so that they are flatly in contact with sections of this outer contour.

Reference is explicitly made to the fact that, e.g., two sheets of paper bonded to one another are flatly (flushly) in contact with one another. This example illustrates that a flat contact (flush contact) can be embodied not only by a direct, immediate contact, but also by a contact in which a bonding agent, for example, a solder, an adhesive or a heat-conducting paste, whose use is advantageous, is involved. On the one hand, any direct contact with the fluid to be heated or with the fluids to be heated is ruled out by this construction, while a very good heat transfer can be ensured at the same time by the flat contact. Another essential aspect is that due to the fact that the tubes are arranged such that they surround the heater, the heat made available by the heater can be fully utilized.

Furthermore, it is pointed out for clarification that the terms "surround" and "enclose" are to be clearly distinguished from one another within the framework of the present invention. "Surround" means that when viewed at right angles to the direction in which the surrounded tubular heating body extends, sections of one or more tubes for passing through a fluid to be heated are arranged starting from the surrounded tubular heating body in a plurality of directions, which also form, in particular, angles exceeding 90° with each other. Consequently, gaps may also be present between adjacent tubes, and the respective tube sections also do not have to be absolutely in flat contact with one another, even though this leads to an embodiment in which there is an especially low risk of contamination.

Only the term "enclose" is used in the sense that when viewed in all directions at right angles to the direction in which the surrounded tubular heating body extends, sections of one or more tubes for passing through a fluid to be heated are arranged starting from the surrounded tubular heating body.

At least two tubes are present and the tubes are connected to one another by means of a connection means in a preferred embodiment of the present invention.

If the connection means is a tensioning means, for example, a tightening strap or a clamping clip, which braces the tubes against each other, a flow heater may be provided, which can again be disassembled into its components by releasing or severing the tensioning means, so that the defective individual component can be simply replaced instead of the entire flow heater in case of a defect.

However, as an alternative to this, a connection by soldering, bonding or welding of the tubes with one another and/or with the metal jacket of the heater may be provided as well. Soldered joints, bonded joints or welded joints, especially weld seams, bind the connection means in this case. This leads to a more simple assembly of the flow heater.

In a preferred embodiment, the sections of the walls of the tubes, which said sections face away from the heater, form, optionally together with a connection means arranged between them, the outer contour of the flow heater. This leads to a smooth, continuous surface structure, which minimizes the risk of contamination.

The optional heat transport tube creates an additional degree of freedom for coordination between the desired fluid throughout and the needed heat output at a given length of the flow heater, because the size of the heated inner tube surface can thus be varied. In addition, the thermal contact between the heater and tubes for passing through a fluid to be heated or a plurality of fluids to be heated can be improved by selecting a material with higher elasticity and/or lower hardness and/or better deformability compared to the material of the metal jacket of the tubular heating body, especially if the material of the heat transport tube has a higher thermal conductivity than the material of the metal jacket of the heater.

To monitor the function of the flow heater, it is advantageous to provide a measuring and/or regulating element, which is arranged between the tubes in thermal contact with the heater. The measuring and/or regulating element is preferably connected in series with a resistance wire winding of the heater, because rapid response and short reaction times can thus be obtained in case of a malfunction.

It is advantageous, furthermore, if at least one tube for passing through a fluid to be heated or a plurality of fluids to be heated has, in the direction in which it extends, cross sections varying in contour, especially a crescent-shaped cross section and a round cross section in the end area. This makes it possible to make available simple connection possibilities for the tube despite a shape of the tube that permits flat contact with the heater or the optional heat transport tube.

The process according to the present invention for manufacturing a flow heater has the following steps:

Providing a heater with a metal jacket, which may be made with or without heat transport tube, especially a tubular heating body, and at least two tubes for passing through a fluid to be heated or a plurality of fluids to be heated, wherein at least in partial areas of the heater, the sections of walls of the tubes, which said sections face the heater in the assembled state of the flow heater, are adapted to an outer contour of the heater or, if a heat transport tube is present, to an outer contour of the heat transport tube arranged on the heater, and wherein, furthermore, these sections may together essentially imitate the outer contour of the heater or, if a heat transport tube is present, the outer contour of the heat transport tube arranged on the heater;

Arranging the tubes at the heater while bringing about a flat contact between the sections of walls of the tubes, which said sections are adapted to the outer contour of the heater or, if a heat transport tube is present, to an outer contour of the heat transport tube arranged on the heater, preferably with the application of pressure, said tubes being arranged such that these sections together essentially imitate the outer contour of the heater or, if a heat transport tube is present, the outer contour of the heat transport tube arranged on the heater; and Fixing the tubes in this position with the use of a connection means.

This process can be carried out much more simply and at a lower cost than prior-art manufacturing processes for flow heaters. In particular, leakage problems, which may occur when the heater is arranged in the interior space of the tube, are avoided, and the need to prepare recesses in a metal section, into which tubes and heater can be inserted, and then to restore an intimate thermal contact, is eliminated.

The present invention will be explained in more detail below on the basis of drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
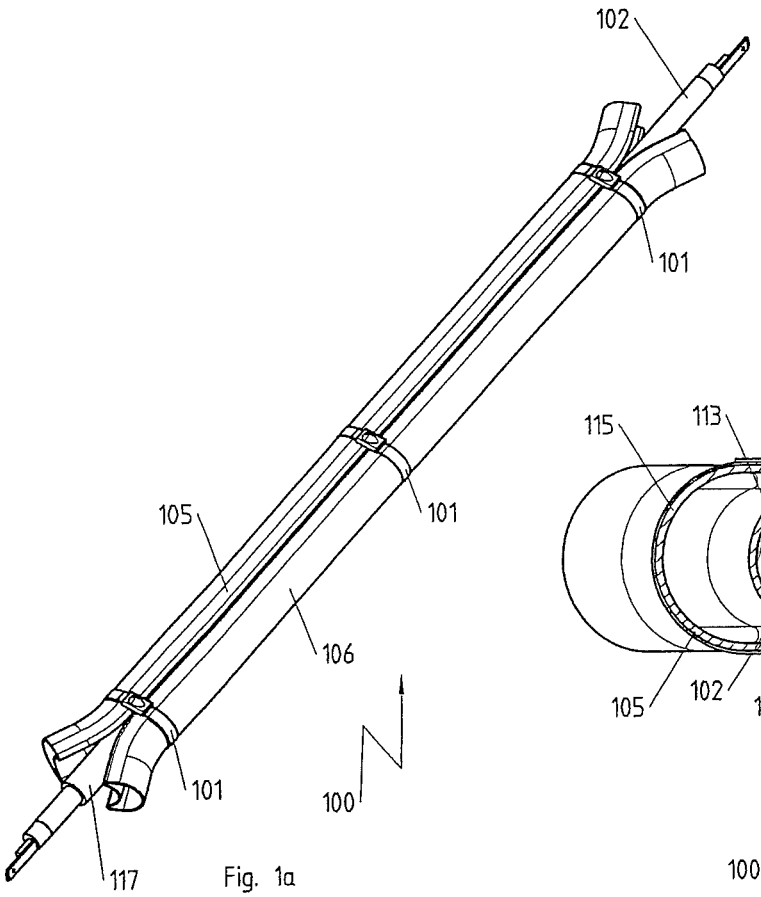
FIG. 1*a* is a perspective view of a first exemplary embodiment of the present invention.

Referring to the drawings in particular, identical reference numbers are used in all figures to designate identical components of identical exemplary embodiments.

FIG. 1 shows a first embodiment of a flow heater 100 according to the present invention with a heater, which is designed as a tubular heating body 102 with a heat transport tube 117 pushed over tubular heating body 102. A tube arrangement comprising two tubes 105, 106 is provided for passing through fluid (a fluid or a plurality of fluids) to be heated. The end sections of the tubes 105, 106 are bent at an angle.

The thermal contact between the tubes 105, 106 and the tubular heating body 102 is thus indirect, taking place via the heat transport tube 117 of the heater. This measure creates an additional degree of freedom for coordination between the desired fluid throughput and the needed heat output at a given length of the flow heater 100, because the size of the heated tube inner surface can thus be varied. In addition, the thermal contact between tubular heating body 102 and tubes 105, 106 for passing through a fluid to be heated can be improved by selecting a material with higher elasticity and/or lower hardness and/or better deformability compared to the material of the metal jacket of the tubular heating body 102, especially if the material of the heat transport tube 117 has a higher thermal conductivity than the material of the metal jacket of the tubular heating body.

Figure 1B:
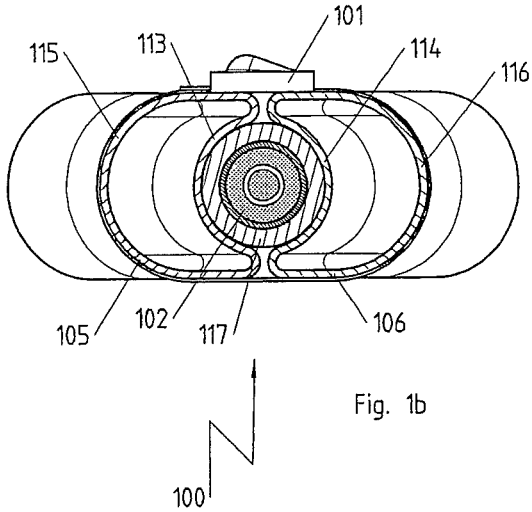
FIG. 1*b* is a cross sectional view through the exemplary embodiment from FIG. 1*a;*

The cross section through the exemplary embodiment according to FIG. 1*a*, which is shown in FIG. 1*b*, shows especially clearly how the tubes 105, 106 for passing through a fluid to be heated surround the tubular heating body 102. This view shows the plane at right angles to the direction in which the tubular heating body 102 extends. Starting from the tubular heating body 102, a section each of a tube 105, 106 for passing through a fluid to be heated is arranged in a plurality of directions. Thus, the tubes 105, 106 surround, in the sense of the present invention, the tubular heating body 102. However, the tubular heating body 102 is not enclosed, because intermediate spaces, in which, for example, a measuring and/or regulating element, not shown, e.g., a thermocouple, could be arranged in thermal contact with the heat transport tube 117, are present in two directions between the tubes 105, 106.

Furthermore, it can be determined from FIG. 1*b* that in the tubes 105, 106, the wall facing the tubular heating body 102 or the wall section 114, 113 facing same is adapted to a respective corresponding section of the surface of the optional heat transport tube 117, so that a surface contact is established, which ensures good heat transfer into the fluid, not shown.

In addition, it is seen that the wall sections 115, 116 of the tubes 105, 106 facing away from the tubular heating body 102 form the outer contour of the flow heater 100. This shows that an approximately crescent-shaped cross section of the tubes 105, 106 is desirable, because this cross section makes possible an adaptation to heat transport tube 117 or tubular heating body 102 just as much as a practical outer contour of the flow heater 100.

Another tube cross section, which is preferred for many applications and can be advantageously used in connection with all exemplary embodiments, is a cross section that corresponds to a partial segment of a ring.

This view shows, furthermore, an exemplary, typical inner structure of the tubular heating body 102, known in itself, which has here, for example, within a metal jacket, a coil of a heat conductor, embedded in an insulating material, or a resistance wire.

A connection means in the form of tensioning means 101 designed as tightening straps are seen in both the view according to FIG. 1*a* and the view according to FIG. 1*b* (as can be determined from FIG. 1*a*, at three points of the flow heater 100, but it is also possible to use more or fewer as needed). This tensioning means bring about the pressing of the tubes 105, 106 onto the heat transport tube 117, which is in turn pressed onto the tubular heating body 102. Optimization of the thermal contact is brought about by this pressing pressure.

This embodiment of the present invention is characterized, on the one hand, by an especially compact design and very inexpensive manufacture, and, on the other hand, an intimate thermal contact is also permanently ensured by it.

Figure 2A:
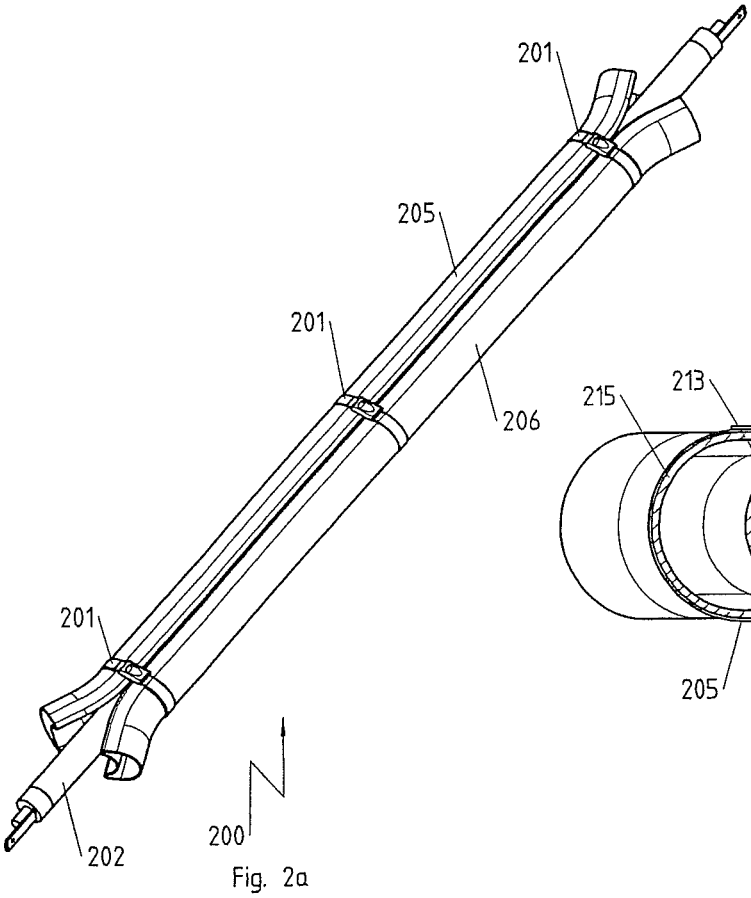
FIG. 2*a* is a perspective view of a second exemplary embodiment of the present invention.
Figure 2B:
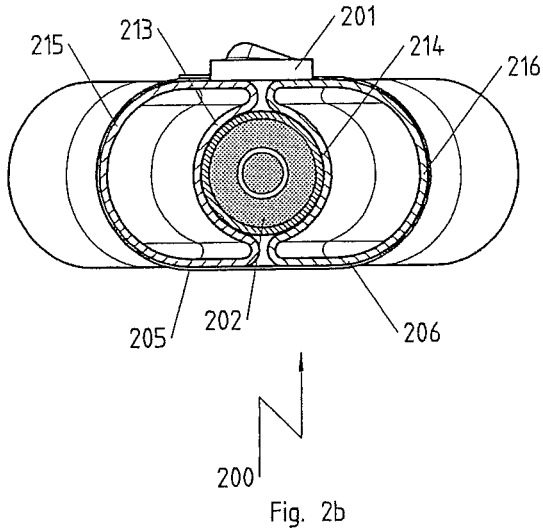
FIG. 2*b* is a cross sectional view through the exemplary embodiment from FIG. 2*a;*

FIGS. 2*a* and 2*b* show a second embodiment with a flow heater 200 according to the present invention. The flow heater 200 includes a tubular heating body 202 and a tube arrangement including tubes 205 and 206 having wall sections 213, 214, 215 and 216. A tensioning means 201 is provided. The flow heater 200 differs from the view according to FIGS. 1, 1*a* and 1*b* only in that no heat transport tube is provided, which is especially advantageous if very small space is available for installation. In this case, the outer contour of the heater is the metal jacket of the tubular heating body 202.

Figure 3A:
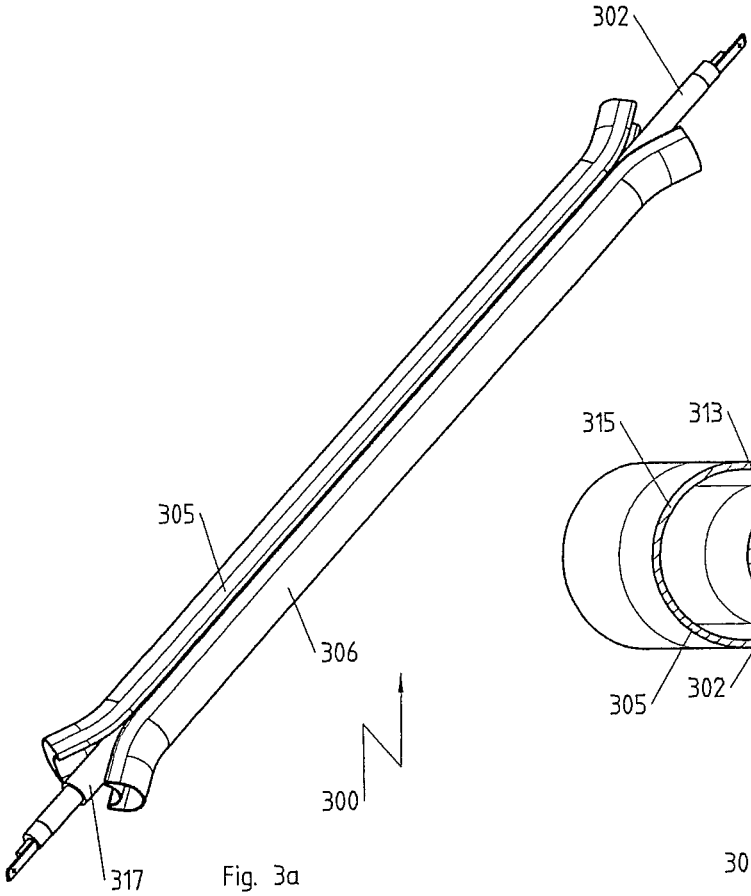
FIG. 3*a* is a perspective view of a third exemplary embodiment of the present invention.
Figure 3B:
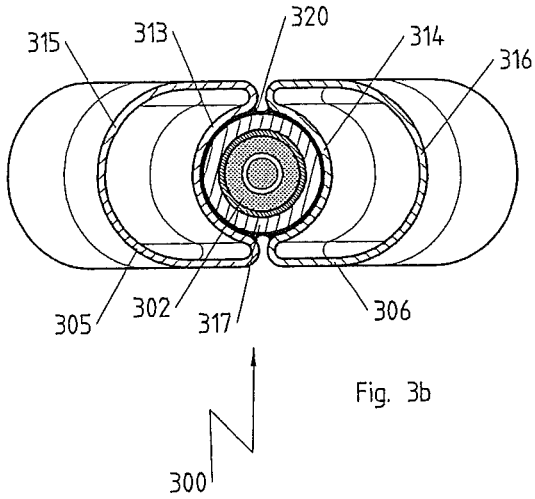
FIG. 3*b* is a cross sectional view through the exemplary embodiment from FIG. 3*a;*

The third embodiment of the present invention is a flow heater 300 shown in FIGS. 3*a* and 3*b*. The flow heater 300 includes a tubular heating body 302 and a tube arrangement including tubes 305 and 306 having wall sections 313, 314, 315 and 316. The flow heater 300 differs from the first embodiment according to FIGS. 1*a* and 1*b* only concerning the connection means selected, which is designed here, as can be seen especially clearly from FIG. 3*b*, as a soldered joint 320 between the tubes 305, 306 and the heater in the form of the tubular heating body 302.

Figure 4A:
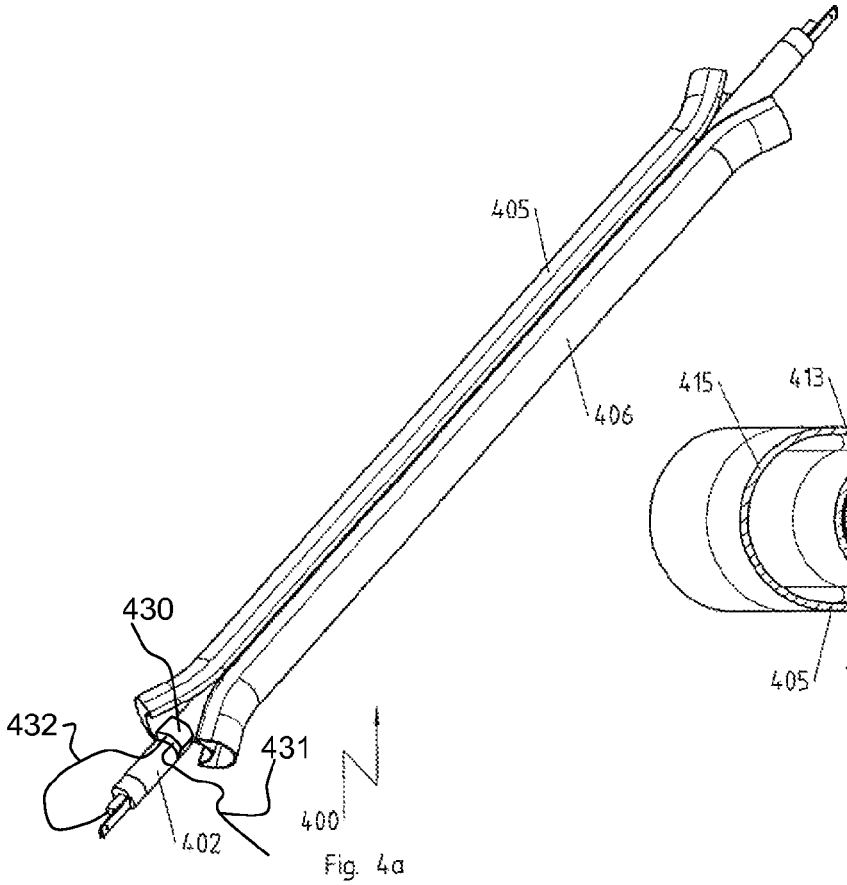
FIG. 4*a* is a perspective view of a fourth exemplary embodiment of the present invention.
Figure 4B:
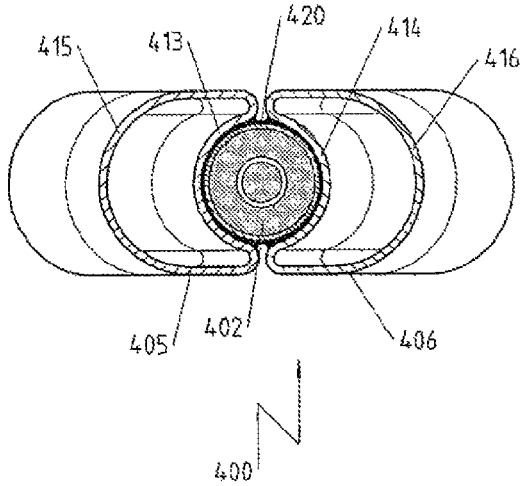
FIG. 4*b* is a cross sectional view through the exemplary embodiment from FIG. 4*a;*

FIGS. 4*a* and 4*b* show a flow heater 400 according to a fourth exemplary embodiment of the invention. The flow heater 400 includes a tubular heating body 402 and a tube arrangement including tubes 405 and 406 having wall sections 413, 414, 415 and 416. The flow heater 300 differs from the second embodiment according to FIGS. 2*a* and 2*b* by the same features as the third exemplary embodiment according to FIGS. 3*a*, 3*b* differs from the first exemplary embodiment according to FIGS. 1*a*, 1*b* in that no heat transport tube is provided. The outer contour of the heater is defined by the metal jacket of the tubular heating body 202.

FIG. 4*a* also shows a measuring and/or regulating element (a bimetallic switch) 430, which is connected to a power source (not shown) by the connection 431. The connection 432 connects the switch 430 in series to the resistance wire.

Figure 5A:
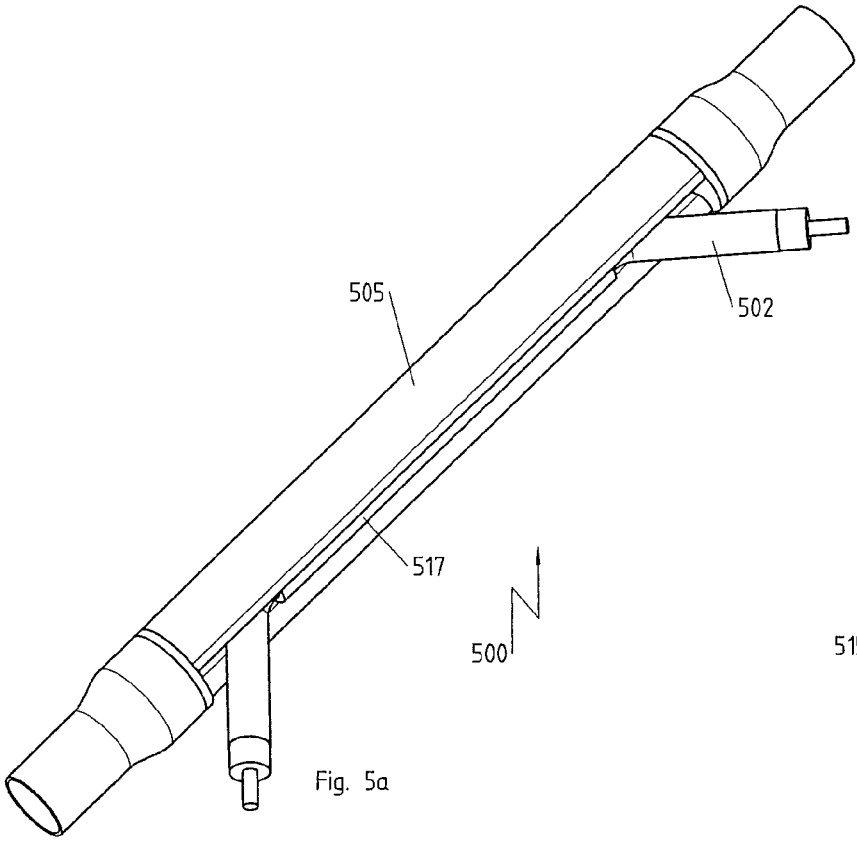
FIG. 5*a* is a perspective view of a fifth exemplary embodiment of the present invention.
Figure 5B:
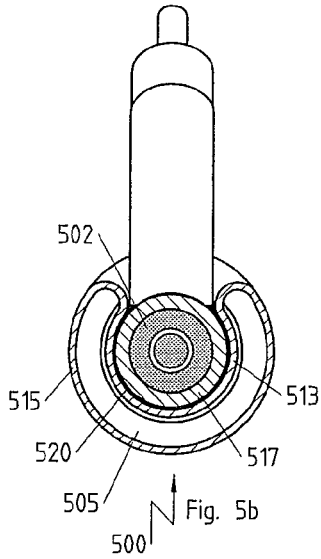
FIG. 5*b* is a cross sectional view through the exemplary embodiment from FIG. 5*a.*

FIGS. 5*a* and 5*b* show a fifth exemplary embodiment of the present invention. The flow heater 500 has a heater including a with a metal jacket, which said heater is designed here as a tubular heating body 502 with a heat transport tube 517 pushed over it to provided the outer contour of the heater. The flow heater 500 further includes a tube arrangement comprising a single tube 505 for passing through a fluid to be heated.

The tube 505 pushed over the heat transport tube 517 and fastened on same by means of a soldered joint 520 has a cross-sectional shape of a partial segment of a ring, through the opening of which the bent end sections of the tubular heating body 502 are passed and which surrounds, but does not enclose, the tubular heating body and the heat transport tube in the sense defined above according to this patent specification in some sections, namely, in the area of the tubular heating body 502 between the bent end sections thereof. Thus, it is possible in this exemplary embodiment as well to use an optional measuring and/or regulating element, not shown, for example, a temperature sensor, for monitoring the heater in this exemplary embodiment as well.

Furthermore, it can be determined from FIG. 5*b* that the wall facing the tubular heating body 502 or the wall section 513 facing same is adapted in tube 505 to a corresponding section of the surface of the optional heat transport tube 517, so that a surface contact is established, which ensures good heat transfer into the fluid, not shown.

In addition, it is seen that the wall section 515 facing away from the tubular heating body 502 forms the outer contour of the flow heater 500.

Furthermore, the typical inner structure of the tubular heating body 502, which is known per se and which has, for example, within a metal jacket, a coil of a heat conductor embedded in an insulating material or a resistance wire, is again seen in this view as well.

In all the embodiments that have a tube arrangement with more than one tube for passing through the fluid to be heated, different fluid circuits can be supplied with the different tubes. In particular, the possibility of making available different quantities of fluid with one flow heater, which is due to the design according to the present invention, is pointed out.

Features that can be found in some of the embodiments only may be combined with the other embodiments shown unless they contradict features of these embodiments.

While specific embodiments of the invention have been shown and described in detail to illustrate the application of the principles of the invention, it will be understood that the invention may be embodied otherwise without departing from such principles.

Appendix

List of Reference Numbers

100, 200, 300, 400, 500 Flow heater

101 Tensioning means

102, 202, 302, 402, 502 Tubular heating body

105, 106, 205, 206, 305, 306, 405, 406, 505 Tube

113, 114, 115, 116, 213, 214, 215, 216, 313, 314, 315, 316, 413, 414, 415, 416, 513, 515 Wall section

117, 317, 517 Heat transport tube

320, 420, 520 Soldered joint

What is claimed is:

1. A flow heater comprising:

a heater with an outer contour and comprising a tubular heating body with a metal jacket; and a tube arrangement for passing through fluid to be heated, said tube arrangement comprising a first tube and a second tube, said tube arrangement surrounding said heater at least in some sections, said first tube comprising first tube wall sections facing said heater and said first tube having a first tube inner contour, said second tube comprising second tube wall sections facing said heater and said second tube having a second tube inner contour, said first tube inner contour and said second tube inner contour being adapted to said outer contour of said heater, whereby said first tube wall sections facing the heater and said second tube wall sections facing the heater are in flush contact with sections of said outer contour, wherein a sum of a dimension of said first tube inner contour and a dimension of said second tube inner contour substantially corresponds to a dimension of said outer contour.

2. A flow heater in accordance with claim 1, wherein said tube arrangement comprises connection means for connecting the first tube and the second tube one another and/or to the heater.

3. A flow heater in accordance with claim 2, wherein the connection means comprises a tensioning means with which the first tube and the second tube are braced against each other.

4. A flow heater in accordance with claim 2, wherein the connection means is arranged between the first tube and the second tube and the heater and comprises at least one of a soldered joint, a bonded joint or a weld seam.

5. A flow heater in accordance with claim 1, wherein the first tube wall sections and the second tube wall sections include outer wall sections that face away from the heater, said outer wall sections forming an outer contour of the flow heater.

6. A flow heater in accordance with claim 1, wherein said heater comprises a heat transport tube provided outwardly of said tubular heating body with said metal jacket, said heat transport tube defining said outer contour and being formed of a material that has a higher coefficient of thermal conduction than a material of said metal jacket.

7. A flow heater in accordance with claim 6, wherein said heat transport tube is formed of a material with a higher elasticity and/or lower hardness and/or better deformability than a material of the metal jacket.

8. A flow heater in accordance with claim 2, further comprising: a measuring and/or regulating element is provided, which is arranged between at least said first tube and said second tube in thermal contact with the heater.

9. A flow heater in accordance with claim 8, wherein said heater comprises a resistance wire winding within said metal jacket; and said measuring and/or regulating element is connected in series with a resistance wire winding of the heater.

10. A flow heater in accordance with claim 1, wherein said first tube and said second tube have a cross section varying in contour including a crescent-shaped cross section in a middle area and a round cross section in an end section.

11. A flow heater in accordance with claim 1, wherein said first tube comprises a first tube inner surface, said first tube inner surface defining a first fluid flow path, said second tube comprising a second tube inner surface, said second tube inner surface defining a second fluid flow path, wherein a first fluid passes along said first fluid flow path and a second fluid passes along said second fluid flow path.

12. A flow heater comprising:

a heater comprising a tubular heating body with a metal jacket; and a tube arrangement comprising a first tube and a second tube, said first tube receiving a first tube fluid to define a first fluid flow path, said second tube receiving a second tube fluid to define a second fluid flow path, said first tube comprising a first tube inner surface having a first tube inner contour, said second tube comprising a second tube inner surface having a second tube inner contour, said first tube inner contour surrounding a first portion of said heater, said second tube inner contour surrounding a second portion of said heater, said first tube inner contour facing said first portion of said heater, said second tube inner contour facing said second portion of said heater, said first portion of said heater comprising a first heater outer contour, said second portion of said heater comprising a second heater outer contour, said first tube inner contour substantially corresponding to said first heater outer contour, said second tube inner contour substantially corresponding to said second heater outer contour, wherein said first tube inner contour is in direct contact with said first heater outer contour and said second tube inner contour is in direct contact with said second heater outer contour.

13. A flow heater in accordance with claim 12, wherein said first tube and said second tube are mirror symmetrical, whereby said first tube inner contour and said second tube inner contour are mirror symmetrical, said first heater outer contour and said second heater outer contour being mirror symmetrical, said heater being arranged between said first tube inner contour and said second tube inner contour.

14. A flow heater in accordance with claim 13, wherein a sum of a dimension of said first tube inner contour and a dimension of said second tube inner contour substantially corresponds to a dimension of said outer contour.

15. A flow heater in accordance with claim 11, wherein said tube arrangement comprises a connection means for one or more of connecting the first tube to the second tube and connecting said first tube and said second tube to said heater.

16. A flow heater in accordance with claim 15, wherein the connection means comprises a tensioning means with which the first tube and the second tube are braced against each other, said tensioning means being in direct contact with said first tube and said second tube.

17. A flow heater in accordance with claim 15, wherein the connection means is arranged between the first tube and the second tube and the heater and said connection means comprises at least one of a soldered joint, a bonded joint or a weld seam.

18. A flow heater in accordance with claim 12, wherein said first tube comprises first tube outer wall sections and said second tube comprises second tube outer wall sections, said first tube outer wall sections and said second tube outer wall sections facing away from the heater, said first tube outer wall sections and said second tube outer wall sections forming an outer contour of the heater.

19. A flow heater in accordance with claim 12, wherein said heater comprises a heat transport tube provided outwardly of said tubular heating body with said metal jacket, said heat transport tube defining an outer contour of said heater and being formed of a material that has a higher coefficient of thermal conduction than a material of said metal jacket, said first tube inner surface engaging a first portion of said heat transport tube, said second tube inner surface engaging a second portion of said heat transport tube.

20. A flow heater in accordance with claim 19, further comprising:

a measuring and/or regulating element arranged between at least said first tube and said second tube in thermal contact with the heater, wherein said heat transport tube is formed of a material with a higher elasticity and/or lower hardness and/or better deformability than a material of the metal jacket.

* * * * *